US006461783B1

(12) United States Patent
Kim et al.

(10) Patent No.: US 6,461,783 B1
(45) **Date of Patent: *Oct. 8, 2002**

(54) MICRO-SERRATED COLOR TONER PARTICLES AND METHOD OF MAKING SAME

(75) Inventors: Chul-Hwan Kim, Saejon (KR); Seung-Wook Lim, Saejon (KR); Jongkwan Kim, Inchon (KR); Hyun-Nam Yoon, Towaco, NJ (US)

(73) Assignee: DPI Solutions, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,959

(22) Filed: May 18, 2001

(51) Int. Cl.[7] ..... G03G 9/08

(52) U.S. Cl. ..... 430/137.1; 430/137.21; 430/110.3; 430/110.4

(58) Field of Search ..... 430/137.1, 137.21, 430/137.14, 110.3, 110.4

(56) References Cited

U.S. PATENT DOCUMENTS

| | | | | |
|---|---|---|---|---|
| 2,297,691 A | | 10/1942 | Carlson | 95/5 |
| 3,590,000 A | | 6/1971 | Palermiti et al. | 252/62.1 |
| 4,100,087 A | * | 7/1978 | Takayama et al. | 430/137.1 |
| 4,298,672 A | | 11/1981 | Lu | 430/108 |
| 4,338,390 A | | 7/1982 | Lu | 430/106 |
| 4,645,727 A | | 2/1987 | Ong et al. | 430/106 |
| 4,778,742 A | | 10/1988 | Ong et al. | 430/106 |
| 4,880,432 A | | 11/1989 | Egan et al. | 8/647 |
| 4,968,577 A | * | 11/1990 | Kohri et al. | 430/137.1 |
| 5,102,761 A | | 4/1992 | Ohsaki et al. | 430/106 |
| 5,114,821 A | | 5/1992 | Haack | 430/110 |
| 5,200,290 A | | 4/1993 | Ong et al. | 430/115 |
| 5,212,033 A | | 5/1993 | Tsubota et al. | 430/106 |
| 5,227,460 A | | 7/1993 | Mahabadi et al. | 528/272 |
| 5,296,325 A | | 3/1994 | Ohtsuka et al. | 430/106 |
| 5,352,521 A | | 10/1994 | Hotta et al. | 428/402 |
| 5,376,494 A | | 12/1994 | Mahabadi et al. | 430/137 |
| 5,437,953 A | | 8/1995 | Russell et al. | 430/106 |
| 5,470,687 A | | 11/1995 | Mayama et al. | 430/137 |
| 5,500,321 A | | 3/1996 | Kasuya et al. | 430/109 |
| 5,565,298 A | | 10/1996 | Suguro et al. | 430/137 |
| 5,693,444 A | | 12/1997 | Takagi et al. | 430/106.6 |
| 5,866,662 A | | 2/1999 | Hatke et al. | 526/160 |
| 6,001,524 A | | 12/1999 | Yoon et al. | 430/106 |
| 6,156,473 A | | 12/2000 | Tyagi et al. | 430/137 |
| 6,287,742 B1 | | 9/2001 | Yoon | 430/137.19 |

FOREIGN PATENT DOCUMENTS

| | | | |
|---|---|---|---|
| GB | 1373531 | 11/1974 | C08G/20/02 |
| JP | 3-121466 | 5/1991 | G03G/9/087 |
| JP | 5-134458 | 5/1993 | G03G/9/087 |

OTHER PUBLICATIONS

Webster's II, New Riverside Dictionary. Houghton–Mifflin. p. 1066. (1984).*

Powder Technology Handbook, 2nd edition, Marcell Dekker Publications (1997), pp. 3–13, by K. Gotoh et al.

Physical Chemistry of Surfaces, 6th edition, by A.W. Adamson and A.P. Cast (1997), John Wiley and Sons, NY, NY.

Aldrich Handbook of Fine Chemicals and Laboratory Equipment 2000–2001, Milwaukee, p. 1372.

(List continued on next page.)

*Primary Examiner*—Christopher Rodee
(74) *Attorney, Agent, or Firm*—Michael W. Ferrell

(57) ABSTRACT

A particulate toner composition is provided with toner resin particles containing a resin component, a colorant component, and optionally a charge control agent characterized in that the toner resin particles have a micro-serrated surface exhibiting a surface roughness index of greater than about 1.2. The novel toner particles are produced by employing a vaporizable plasticizer which is flashed off during processing.

21 Claims, 2 Drawing Sheets

OTHER PUBLICATIONS

Polymer Science Dictionary, London: Elsevier Applied Science, pp. 361 and 385, by Mark S.M. Alger.
Chemical Abstract Registry Numbers 17418–58–5, 31810–89–6 and 6439–53–8.
U.S. Serial No. 09/457,543, filed Dec. 9, 1999, entitled "Method of Producing Toner for Developing Latent Electrostatic Images by Way of Dispersion Dyeing", of H–N Yoon.
U.S. Serial No. 09/826,543, filed Apr. 5, 2001, entitled "Method of Producing Toner for Developing Latent Electrostatic Images by Way of Dispersion Dyeing", of H–N Yoon (same specification as USSN 09/457,543, filed Dec. 9, 1999; pending claims, only, attached.
U.S. Serial No. 09/860,953, filed May 18, 2001, entitled "Micro–Serrated Color Toner Particles and Method of Making Same", of C–H Kim et al.

* cited by examiner

MICRO-SERRATED COLOR TONER PARTICLES AND METHOD OF MAKING SAME

CROSS-REFERENCE TO RELATED APPLICATION

The present invention is related to and an improvement over that disclosed in a pending patent application, Ser. No. 09/571,772, filed on May 16, 2000, now U.S. Pat. No. 6,287,742 the disclosure of which is incorporated herein by reference.

TECHNICAL FIELD

This invention generally relates to toner compositions and a dispersion comminution method of producing toners for developing latent electrostatic images in electrophotography, electrostatic recording and electrostatic printing. More specifically, this invention relates in a preferred embodiment to a dispersion comminution method of forming suitably sized resin particles which incorporate a coloring agent and other suitable components therein for high-resolution electrophotography, electrostatic recording and electrostatic printing.

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or over coating treatment.

Also well known are techniques to develop such electrostatic images. Developer is a vehicle in which are dispersed charged colored toner particles. The photoreceptor bearing the electrostatic latent image is contacted with the developer. The contact causes the charged toner particles in the developer to migrate to the charged areas of the photoreceptor to develop the latent image. Then, the photoreceptor is developed with the charged colored particles adhering to the latent image in image configuration. The developed image is then typically transferred to a suitable substrate, such as paper or transparency material, and optionally may be fixed to the substrate by heat, pressure or other suitable means.

Toners and developer compositions including colored particles are well known. In this regard, see U.S. Pat. Nos.: 5,352,521; 4,778,742; 5,470,687; 5,500,321; 5,102,761; 4,645,727; 5,437,953; 5,296,325 and 5,200,290 the disclosures of which are hereby incorporated by reference. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, from 0 to about 6 weight percent wax, from 0 to about 3 weight percent charge control agent, about 0.25–1 weight percent flow agent and from 0 to about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, and mixtures thereof.

Conventional color toner particles are produced by a milling process described, for example, in the aforementioned U.S. Pat. No. 5,102,761. In that process, a polyacrylate resin is compounded with pigments, charge control agents ("CCA") and occasionally wax in a melt mixer. The resulting polymer mixture is mechanically crushed and then milled into small particles. The conventional toner particles typically have an irregular shape and a broad distribution in particle size. For optimum resolution of images and color, smaller particles perform better. Thus, for example, it is difficult to obtain resolutions better than about 600 dots/inch when the average particle size is more than about 7 $\mu$m. For resolutions in the order of about 1200 dots/inch, particle sizes smaller than 5 $\mu$m are typically needed. It is difficult to make particles smaller than about 7–10 $\mu$m by conventional processes because of the high energy cost of producing small particles as well as uniform narrow particle size distribution.

Many previous attempts to produce small toner particles with the size smaller than 7 $\mu$m have been made. For example, the aforementioned U.S. Pat. Nos. 5,352,521, 5,470,687 and 5,500,321 disclose toner particles produced by dispersion polymerization. In such a method, monomers (typically styrenic and acrylate monomers) and additives such as pigments, CCA and wax are mixed together to form a dispersion. This is then further dispersed into an aqueous or a non-aqueous medium and the monomers are polymerized to form toner particles. This method has the advantage over other methods in that spherical toner particles with a small diameter can be prepared by a single process. However, the polymerization involves a substantial volume contraction and it results in entrapment of the dispersion medium inside the toner particles. Furthermore, the polymerization is difficult to be brought to completion and a substantial portion of the monomers remains in the toner particles. The residual monomers and the entrapped dispersion solvent are difficult to separate from the particles. Also, the polarity of the polymerizing materials changes drastically in the course of the polymerization and the additives tend to exude from the particle bulk and tend to concentrate on the surface thereof. Further, agents employed, such as dispersion-stabilizing agent and surface active agent, which cause the charging characteristics and preservability of the toner particles to deteriorate, remain on the surface of the toner particles, and those agents are extremely difficult to remove from the toner particles.

A co-pending application. U.S. patent application, Ser. No. 09/571,772, discloses a method of producing toner particles by comminuting resin particles comprising a colorant and a charge control agent in a solvent which does not dissolve the resin. However, applicability of the method is somewhat limited to toner resins with a relatively low molecular weight and the method generally requires a moderately high temperature and a vigorous shearing for effective comminution of toner particles. Furthermore, the toner particles produced by the method generally have a smooth surface texture and tend to lack a fast triboelectric charging characteristics which is important in mono-component electrophotography development systems.

Another desirable property in a particulate toner composition is a narrow particle size distribution. It is generally believed that a narrow size distribution leads to a more uniform charge distribution in the toner composition which, in turn. leads to a better line resolution in a printed image as well as reduction in spotty background. The conventional milling method of producing toner particles is generally inefficient in producing particles with a narrow size distribution and therefore has to employ a classification step to remove particles that are too small or too large from the toner composition.

Narrowness of the size distribution may be expressed by the 80% span (the span). The span is defined as the ratio of the size range in which middle 80% by volume of the particles occupy to the median size. A more detailed description of the definition of the span is in a later section on the characterization methods used in the present invention. A smaller value of the span therefore means a narrower size distribution. The span value of a typical toner composition which is commercially available after afore-mentioned classification step is about 1.2. A method of toner particle formation yielding particles with the span value less than 1.2 without a classification process is highly desirable.

There is continuing interest in the development of new and improved methods of producing toners for application in high-resolution electrophotography. Some such methods have included the suggestion of dispersing polymer/solvent droplets in a water medium and shearing the mixture. However, water tends to get into the interstices between particles and agglomerate them. Once agglomeration occurs, it is very difficult to drive off the water without damaging or otherwise altering the physical properties of the particles, especially with respect to polymers having relatively low softening points, that is, below about 100° C.

Accordingly, an object of the present invention is to provide an improved dispersion comminution method of producing high-resolution color toner which has a superior combination of properties for electrophotographic imaging systems by forming spherical toner particles with a small diameter by way of dispersing a polymer resin compounded with a colorant, a vaporizable plasticizer component and other additives in a dispersion medium including a surfactant under a vigorous shearing condition.

Another object of the present invention is to provide an improved dispersion comminution method of producing high-resolution color toner composition, wherein the comminution step may be carried out at a substantially low temperature compared to the method disclosed aforementioned U.S. patent application Ser. 09/571,772.

Yet another object of the present invention is to provide an improved dispersion comminution method of producing high-resolution toner, wherein a polymer resin with a substantially high molecular weight may be expeditiously comminuted.

Still another object of the present invention is to provide a method of producing toner particles comprising a polymer resin, a colorant and optionally a charge control agent, which particles are substantially spherical in shape with a diameter in the range of about 1 to 10 $\mu$m as well as a narrow particle size distribution.

A still yet further object of the present invention is to provide a particulate toner composition of particles which are substantially spherical in shape and have a serrated surface texture.

Yet another object of the present invention is to provide a toner composition which exhibits a fast triboelectric charging behavior and therefore are suitable for applications in a mono-component electrophotography development system.

Other objects and advantages of the present invention shall become apparent from the accompanying description and examples.

SUMMARY OF INVENTION

There is provided in accordance with the present invention particulate toner resin particles containing a resin component, a colorant component, and optionally a charge control agent characterized in that the toner resin particles have a micro-serrated surface exhibiting a surface roughness index of greater than about 1.2. Roughness indices of greater than about 1.5 or 2 are believed readily achieved if so desired.

In another aspect of the present invention there is provided a process for preparing a particulate toner composition for developing latent electrostatic images including the steps: a) preparing a first resin composition containing a resin component, one or more colorant components, optionally a charge control agent, other additives such as wax and fumed silica and a vaporizable plasticizer component which reduces the melt viscosity of the resin composition and thereby facilitates the overall comminution process of this invention; b) dispersing the resin composition in an organic medium comprising a surfactant, wherein the resin component is substantially insoluble in the organic medium; c) comminuting the resin composition to form particulate resin particles by an application of shear at an elevated temperature; d) removing the vaporizable plasticizer component by evaporation by maintaining the dispersion of particulate toner composition in the medium at a second elevated temperature; e) recovering the toner particles using a filtration process, followed by washing with an organic solvent with a low boiling temperature and subsequently drying the particles. Optionally, fumed silica particles are blended with the toner particles to improve flow characteristics of the toner particles. Without intending to be bound by any theory, it is believed the micro-serrated structure of the toner particles is imparted to them during removal of the vaporizable plasticizer.

In a preferred aspect, the particulate toner composition comprises a polymer resin, one or more colorants that may be pigments, dyes or combinations thereof, an optional charge control agent and other additives commonly used in the preparation of a toner composition such as wax, fumed silica particles, etc. The toner particles are substantially spherical in shape and have a volume average diameter in the range of from about 1 to about 10 microns. Furthermore, the toner particles have a uniform and narrow size distribution with the span value less than 1.0, more preferably, with the span value less than 0.8. A particularly desirable and surprising aspect of the present invention is that the toner particles may be made to have an irregular surface texture that increases the surface area and thus substantially improves the triboelectric charging characteristics of the toner composition such as the charging speed. A fast triboelectric charging characteristics of a toner composition is particularly important when the toner composition is used in a mono-component development systems which are widely employed in desktop laser printers.

Any suitable polymer resin may be employed as the resin component of the present invention. Particularly preferred resins include polyester resins and styrene copolymer resins. The polymer resin is typically an amorphous resin with a glass transition temperature in the range of from about 40° C. to about 90° C. The use of a vaporizable plasticizer component in the present method of producing toner particles significantly increases the molecular weight range of polymer resin usable for toner application. A desirable molecular weight range of a polymer resin processable with the method of the present invention is a weight average molecular weight in the range of from about 3000 g/mol to about 100,000 g/mol. The resin may optionally contain functional moieties which improve the compatibility with colorants as a part of its polymer chain chemical structure.

The first resin composition is typically prepared by melt mixing the resin component with a colorant, optionally with a charge control agent and other additives, and also with the vaporizable plasticizer component. The colorant is typically selected from cyan pigments or dyes, yellow pigments or dyes, magenta pigment or dyes and black pigments or dyes. The charge control agent may be dispersed in the resin and may be a positive charge control agent or a negative charge control agent. Other additives commonly used in a toner composition such as wax and famed silica particles may be dispersed.

Presence of the vaporizable plasticizer component significantly reduces the flow temperature of the first resin composition and therefore allows the whole toner preparation process to be carried out at a substantially lower temperature than the process without a vaporizable plasticizer component. The vaporizable plasticizer component may be present in any suitable amount. In general, vaporizable plasticizer in an amount between about 1 to about 200 weight percent of the resin component in the melt mixture is employed; with from about 5 to about 100 weight percent of the resin component being typical. From about 5 to 50 weight percent or 10 to 30 weight percent of the resin component may, for example, be preferred in some embodiments. The vaporizable plasticizer component is selected from organic solvents which are absorbable in the polymer resin component and have a boiling temperature less than 200° C. It is preferable that the vaporizable plasticizer component is insoluble in the organic medium employed in the dispersion preparation and comminution steps of the present invention. Typical vaporizable plasticizers may include acetone, 1,2-dichlorethane, tetrahydrofuran, acetonitrile, 1 -methyl-2-pyrrolididone, methylethylketone, 3-pentanone, chlorobenzene, N,N-dimethylformamide, cyclohexanone, and dimethylsulfoxide. Preferred examples of the vaporizable plasticizer components are acetone, dimethylformamide, cyclohexanone, dimethylsulfoxide, and chlorobenzene. The first resin composition may be prepared by melt compounding at a temperature which is determined, in part, by the choice and the amount of vaporizable plasticizer component in the first resin composition. It is preferable to carry out the preparation of the first resin composition at as low a temperature as is practical.

The first resin composition is dispersed in the immiscible organic medium by subjecting the mixture of the molten resin composition and the organic medium to a shear at an elevated temperature. Any suitable mixing equipment may be employed for this step. An example of such equipment is a vessel equipped with an impeller-type agitator and a means of heating the content of the vessel. Effective formation of dispersion as well as successful comminution requires that the solubility parameter of the organic medium be generally different from the solubility parameter of the resin component by at least about 1. In preferred embodiments the solubility parameter of the organic medium is larger or smaller than the solubility parameter of the resin component by at least about 2. Any suitable organic medium which does not dissolve the resin component may be employed. Particularly preferred solvents include paraffin solvents and poly (ethylene glycol).

The organic medium typically includes a surfactant which may a non-ionic, a cationic or an anionic surfactant. Preferred examples of such surfactants include copolymers of vinylpyrrolidonone, alkylated maleic acid copolymers, polymers containing ethylene oxide moieties, polymers containing propylene oxide moieties and sodium dodecylsulfate. The surfactant is generally present in the organic medium in an amount from about 0.2 to about 15 weight percent based on the amount of solvent present whereas from about 1 to about 10 weight percent based on the amount of solvent present is typical.

The first resin composition is generally from about 10 to about 70 weight percent of the combined weight of the resin composition in the organic medium during the step of dispersing the first resin composition. From about 20 to about 50 weight percent of the combined weight of the first resin composition in the organic medium is more typical. The first resin composition may be introduced to the organic medium maintained at an elevated temperature under a shearing condition. Equally preferably, the organic medium may be introduced to molten first resin composition maintained at an elevated temperature under a shearing condition. During the step of dispersing the first resin composition, the organic medium is maintained at an elevated temperature. The temperature may be selected to be any value so long as it is high enough to ensure fluid-like behavior of the first resin composition and low enough not to have a substantial evaporation of the vaporizable plasticizer component in the first resin composition. Therefore the temperature may be selected to be any value by varying the type and the amount of the vaporizable plasticizer component in the first resin composition. While any suitable elevated temperature may be employed, preferred temperatures are in the range at least about 30° C. to about 200° C.

The step of comminuting the first resin particles is typically carried out by further subjecting the dispersion of the first resin composition in the organic medium at an elevated temperature. The comminuting temperature may be selected to be any value so long as it is high enough to ensure fluid-like behavior of the first resin composition and low enough not to have a substantial evaporation of the vaporizable plasticizer component. Therefore the temperature may be selected to be any value by varying the type and the amount of the vaporizable plasticizer component in the first resin composition. While any suitable elevated temperature may be employed, preferred temperatures are in the range at least about 30° C. to about 200° C. However, it needs not be the same temperature as the dispersion temperature. The shearing required for the comminuting step of the present invention is substantially smaller due to the presence of the vaporizable plasticizer component compared to that for the process without a vaporizable plasticizer component. Effective comminution may be obtained in a vessel containing a 10 cm radius impeller-type agitator and with the agitator rotation speed as low as 100 rpm.

The step of removing the vaporizable plasticizer component from the comminuted first resin composition is typically carried out by maintaining the mixture of the first resin components and the organic medium at a second elevated temperature close to or above the boiling temperature of the vaporizable plasticizer component. Under the condition, the vaporizable plasticizer component evaporates from the comminuted particulate resin composition and subsequently from the processing vessel. The process may be more expeditiously carried out when the vaporizable plasticizer composition is immiscible with the organic medium. The removal step is stopped when the vaporous effluent from the process vessel does not show a trace of the vaporizable plasticizer component.

The steps of dispersion, comminution and removal of the vaporizable plasticizer component may be conducted in distinctive and discontinuous steps, sequentially in a single vessel or in an overlapping manner in a single vessel.

The step of recovering the comminuted toner particles is carried out by first cooling the content of the process vessel below the glass transition temperature of the resin component and subsequently by filtering solid toner particles from the organic medium. Any suitable filtration equipment may be used. Subsequently, dry toner particles are obtained by washing the filtered particles with a low boiling organic solvent such as isohexane and drying off the wash solvent at a temperature below the glass transition temperature of the resin component.

A flow improvement agent, such as fumed silica particles, may be added to the toner composition, typically after the particles have been comminuted.

In another aspect of the present invention, there is provided a particulate toner composition including toner particles that are substantially spherical in shape, have an average diameter of from about 1 to about 10 microns, and have a uniform and narrow size distribution with the span value less than 1.0, more preferably, with the span value less than 0.8, prepared by comminuting a precursor composition comprising a vaporizable plasticizer component in an organic medium under shear at an elevated temperature wherein the particles are substantially insoluble in the organic medium. The toner resin may be a polyester resin or a styrene copolymer resin. The developer compositions may further include carrier particles. Such particles are typically selected from the group consisting of ferrite, steel, iron powder, and mixtures thereof, wherein the powders have a surface active agent coated thereon.

In yet another aspect of the present invention, there is provided a particulate toner composition comprising toner particles that are substantially spherical in shape, have an average diameter of from about 1 to about 10 microns, have a uniform and narrow size distribution with the span value less than 1.0, more preferably, with the span value less than 0.8 and further have an irregular surface texture characterized by the surface roughness index greater than 1.2, the surface roughness index being defined as the ratio of surface areas of the irregular textured particles and smooth texture particles. The toner resin may be a polyester resin or a styrene copolymer resin. The developer compositions may further include carrier particles. Such particles are typically selected from the group consisting of ferrite, steel, iron powder, and mixtures thereof, wherein the powders have a surface active agent coated thereon.

In still yet another aspect of the present invention, there is provided a particulate toner composition comprising a polyester resin component and a colorant component wherein the particles are substantially spherical in shape, have a volume average diameter in the range of from about 1 to about 10 microns, have a uniform and narrow size distribution with the span value less than 1.0, more preferably, with the span value less than 0.8 and have an irregular surface texture characterized by the surface roughness index greater than 1.2 wherein the polyester resin component includes a polyester resin having a weight average molecular weight of about 100,000 g/mol or less.

In general, it may be possible to achieve surface roughness indices of greater than 1.2 or so and up to as high as 5 or more and span values of the particle size distribution of less than 0.8 down to 0.5 or even 0.2.

In a still further aspect of the present invention, there is provided a particulate toner composition comprising a styrene copolymer resin component and a colorant component wherein the particles are substantially spherical in shape, have a volume average diameter in the range of from about 1 to about 10 microns, have a uniform and narrow size distribution with the span value less than 1.0, more preferably, with the span value less than 0.8 and have an irregular surface texture characterized by the surface roughness index greater than 1.2 wherein the styrene copolymer resin component includes a styrene copolymer having a weight average molecular weight of about 100,000 g/mol or less. Particularly preferred styrene copolymer resins include copolymers of styrene and acrylate as well as copolymers of styrene and butadiene.

BRIEF DESCRIPTION OF DRAWINGS

The invention is described in detail below with reference to the various Figures wherein.

DETAILED DESCRIPTION OF THE PREFERRED EMBODIMENTS

Figure 1:
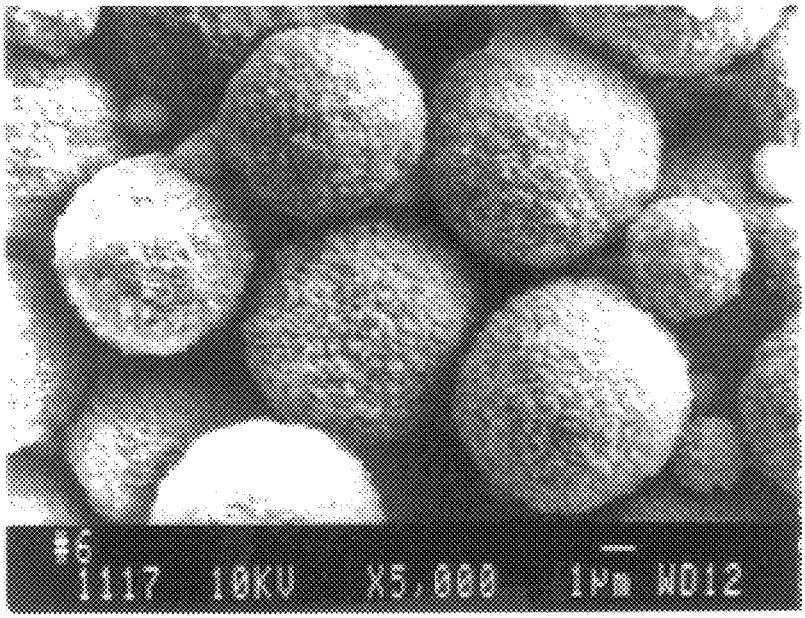
FIG. 1 is a scanning electron micrograph of a toner composition including particles which have a micro-serrated surface texture, generally of the class of the present invention.

The first resin composition is typically prepared by melt compounding a resin component with the colorant component, optionally with a charge control agent and other additives, and also with the vaporizable plasticizer component.

Illustrative examples of suitable toner resins selected for the toner and developer compositions of the present invention include thermoplastics such as polyamides, polyolefins, styrene acrylate, styrene methacrylates, styrene butadienes, cross-linked styrene polymers, ethylene-cycloolefin copolymers, and epoxies, polyurethanes, vinyl resins, including homopolymers or copolymers of two or more vinyl monomers; and polyesters generally, such as the polymeric esterification products of a dicarboxylic acid and a diol comprising a diphenol, reference the known linear polyesters, the polyesters of U.S. Pat. No. 3,590,000, the disclosure of which is totally incorporated herein by reference, and the like. Of the above resin, polyester copolymers, and styrenic copolymers are more preferable for use in the present invention.

The polymer resin may have functional sites in its chain structure to improve the compatibility with a colorant selected from the group consisting of: hydroxyl moieties; alkoxyl moieties; sulfonic or derivatized sulfonic moieties; sulfonic or derivatized sulfonic moieties; carboxyl or derivatized carboxyl moieties; phosphonic or derivatized phosphonic moieties; phosphinic or derivatized phosphinic moieties; thiol moieties, amine moieties; alkyl amine moieties; quaternized amine moieties; and mixtures thereof.

In some embodiments, the weight-average molecular weight ($M_w$) of the toner resin as measured by gel permeation chromatography (GPC) is in the range typically from about 3,000 g/mol to about 100,000 g/mol, and preferably from about 5,000 g/mol to about 20,000 g/mol. The molecular weight distribution ($M_w$,/$M_n$) of the linear polymer is in the range typically from about 1.5 to about 6, and preferably from about 2 to about 4. The onset glass transition temperature ($T_g$) of the linear polymer as measured by differential scanning calorimetry (DSC) is in the range typically from about 50° C. to about 90° C., and preferably from about 50° C. to about 70° C.

As the colorant used in the present invention, commonly known pigments may be used. Illustrative black pigments may include carbon black, aniline black, non-magnetic ferrite and magnetite. Illustrative cyan pigments may include copper phthalocyanine compounds and derivatives thereof; anthraquinone compounds, and basic dye chelate compounds. Particularly preferred cyan pigments are C. I. Pigment Blue 1, 7, 15, 151, 152, 153, 154, 60, 62, and 66. Illustrative magenta pigments may include condensation azo compounds, diketopyropyrrole compounds, anthraquinone compounds, quinacridone compounds, basic dye chelate compounds, naphthol compounds, benzimidazole compounds, thioindigo compounds and perylene compounds. Particularly preferred magenta pigments are C. I. Pigment Red 2, 3, 5, 6, 7, 23, 482, 483, 484, 811, 122, 146, 166, 169, 177, 184, 185, 202, 206, 220, 221, and 254. Illustrative yellow pigments may include condensation azo compounds, isoindolinone compounds, anthraquinone compounds, azo metal complexes, methine compounds, and allylamide compounds. Particularly preferred yellow pigments are C. I. Pigment Yellow 12, 13, 14, 15, 17, 62, 74, 83, 93, 94, 95, 109, 110, 111, 128, 129, 147, 168 and 180.

Any suitable dye may be used in the practice of the present invention so long as it can be bound to the polymer resin. Preferred dyes include disperse dyes, basic dyes, acid dyes, or reactive dyes. The weight ratio to dye to particulate polymer resin is generally from about 1:100 to about 10:100 or from about 1 to about 10 percent by weight.

The colorants are selected taking account of hue, chroma, brightness, weatherability, transparency and dispersibility in toner resins. The colorants may be used alone, in the form of a mixture, or in the state of a solid solution. Further, the colorant particles may be coated with a polymer film to facilitate dispersion of the particles in toner resins. The colorants may be added in the amount of from 1 to 20 parts by weight based on 100 parts by weight of the resin.

Various known suitable effective positive or negative charge controlling additives (CCA) can be selected for incorporation into the toner compositions of the present invention, preferably in an amount of 0 to about 10, more preferably about 1 to about 3, percent by weight. Examples include quaternary ammonium compounds inclusive of alkyl pyridinium halides, alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; bisulfonates; ammonium sulfates (DDAES); distearyl dimethyl ammonium bisulfate (DDAMS), reference U.S. Pat. No. 5,1 14,821, the disclosure of which is totally incorporated herein by reference; cetyl pyridinium tetrafluoroborates; distearyl dimethyl ammonium methyl sulfate, aluminum salts, such as BONTRON E84™ or E88™ (Oriental Chemicals); quaternary ammonium nitrobenzene sulfonates; mixtures of charge enhancing additives, such as DDAMS and DDAES; other known charge additives; and the like. Moreover, effective known internal and external additives may be selected for the toners of the present invention in embodiments thereof.

Also, as indicated herein there can be included in the toner compositions of the present invention low molecular weight waxes, such as polypropylenes and polyethylenes commercially available from EPOLENE N-15™ commercially available from Eastman Chemical Products, Inc., and similar waxes. The commercially available polyethylenes selected have a molecular weight of from about 1,000 g/mol to about 1,500 g/mol, while the commercially available polypropylenes utilized for the toner compositions of the present invention are believed to have a molecular weight of from about 4,000 g/mol to about 7,000 g/mol.

The low molecular weight wax materials are present in the toner composition of the present invention in various amounts, however, generally these waxes are present in the toner composition in an amount of from about 0 percent by weight to about 15 percent by weight, and preferably in an amount of from about 2 percent by weight to about 10 percent by weight.

Incorporation of the vaporizable plasticizer component in the first resin composition significantly reduces the flow temperature of the resin composition and therefore allows the whole toner preparation process to be carried out at a substantially lower temperature than the process without a vaporizable plasticizer component. The vaporizable plasticizer component is selected from organic solvents which are absorbable in the polymer resin component by more than 1 percent by weight and have a boiling temperature less than 200° C. It is preferable that the vaporizable plasticizer component is insoluble in the organic medium used in the dispersion preparation and comminution steps of the present invention. Preferred examples of the vaporizable plasticizer components are; acetone, tetrahydofuran, 1,2-dichloroethane, 1-methyl-2-pyrrolididone, 3-pentanone, cyclohexanone, N,N-dimethylformamide, dimethylsulfoxide, and chlorobenzene. The amount of the vaporizable plasticizer component used in the present varies, however, a typical amount is in the range of from about 5 percent by weight to about 50 percent by weight of the resin component and preferably in the range of about 10 percent by weight to about 30 percent by weight.

For the method of uniformly blending the resins, colorants and charge control agents, conventionally known methods such as melt blending in an agitator-equipped vessel, melt-kneading in a sealed kneader and melt-mixing in a double screw extruder.

The first resin composition is dispersed in the immiscible organic medium comprising an organic solvent component and a surfactant by subjecting a mixture of the molten resin composition and the organic medium to a mild shear at an elevated temperature. Any suitable mixing equipment may be employed for this step. A preferred such equipment is a vessel equipped with an impeller-type agitator and a means of heating the content of the vessel.

Effective dispersion as well as successful comminution at the following step may be accomplished with an organic solvent component that does not dissolve the resin component. More specifically, it is preferable that the solubility parameter value of the solvent component differs from that of the resin by 1.0 or more, more preferably 2.0 or more. For example, it is preferable to employ a nonpolar solvent component having a low solubility parameter value such as paraffins, paraffinic esters, paraffinic amides and paraffinic ethers in combination with polyester resin. However, when a highly polar solvent such as water, methanol, propanol, and acetone is employed as a solvent component for the operation, significant coalescence of the resin results. On the other hand, when a non-polar resin such as a styrenic copolymer resin is dispersed, it is preferable to use a polar solvent component such as poly-(ethylene glycol) with the number average molecular weight leas than 1,000. If a non-polar solvent component such as a paraffin, a paraffinic ester, a paraffinic amide or a paraffinic ether is employed in the dispersion operation of the styrenic copolymer, substantial swelling and coalescence occurs.

A surfactant used in conjunction with the aforementioned organic solvent component in the dispersion operation performs two important functions for successful formation of small toner particles. First, it prevents coalescence of the molten resin particles during the process. In the inventive process, the process is carried out generally at a temperature near to or higher than the glass transition temperature of resin. Thus, in the absence of the surfactant, the particles are in the molten state, tend to coalesce in an uncontrollable manner and thus fail to reduce the particle size to a level suitable for a high-resolution toner. Secondly, the relative amount of surfactant to the amount of resin particles in the bath determines the particle size. The surfactants, because of their chemical structures, tend to concentrate at the interface between the non-solvent and the molten particulate resins. Therefore, a larger amount of surfactant tends to produce smaller particles and a smaller amount tends to produce larger particles. The surfactant may be anionic, cationic or non-ionic.

Preferred examples of such surfactants include copolymers of vinylpyrrolidonone, alkylated maleic acid copolymers, polymers containing ethylene oxide moieties, polymers containing propylene oxide moieties and sodium dodecylsulfate. The surfactant is generally present in the organic medium in an amount from about 0.2 to about 15 weight percent based on the amount of solvent present whereas from about 1 to about 10 weight percent based on the amount of solvent present is typical.

The first resin composition is generally from about 10 to about 70 weight percent of the combined weight of the resin composition in the organic medium during the step of dispersing the first resin composition. From about 20 to about 50 weight percent of the combined weight of the first resin composition in the organic medium is more typical.

The first resin composition may be introduced to the organic medium maintained at an elevated temperature under a mild shearing condition. Equally preferably, the organic medium may be introduced to molten first resin composition maintained at an elevated temperature under a mild shearing condition. Any suitable mixing equipment may be employed for this step. A preferred such equipment is a vessel equipped with an impeller-type agitator and a means of heating the content of the vessel. During the step of dispersing the first resin composition, the organic medium is maintained at an elevated temperature. The temperature may be selected to be any value so long as it is high enough to ensure fluid-like behavior of the first resin composition and low enough not to have a substantial evaporation of the vaporizable plasticizer component in the first resin composition. Therefore the temperature may be selected to be any value by varying the type and the amount of the vaporizable plasticizer component in the first resin composition. While any suitable elevated temperature may be employed, preferred temperatures are in the range at least about 30° C. to about 200° C. The dispersion operation continues until the mixture develops an opalescent appearance which indicates that the first resin component has separated into small particulates.

During the step of comminuting the particles, the organic medium is maintained at an elevated temperature which is close to or higher than the glass transition temperature of the resin component. Any suitable mixing equipment may be employed for this step. A preferred such equipment is a vessel equipped with an impeller-type agitator and a means of heating the content of the vessel. While any suitable elevated temperature may be employed, preferred temperatures are in the range at least about 30° C. to about 200° C. However, it needs not be the same temperature as the dispersion temperature. The shearing action induces break-up of the dispersed resin particles into smaller particles and the surfactant molecules coat the surfaces of the smaller particles thereby preventing the particles to coalesce back into larger particles. The break-up of particles into smaller particles continue until the particle size reaches an equilibrium value determined by the amount of surfactant relative to that of total resin in the vessel. The shearing required for the comminuting step of the present inventive process is substantially smaller due to the presence of the vaporizable plasticizer component compared to that for the process without a vaporizable plasticizer component. For example, effective comminution may be accomplished in a vessel containing a 10 cm radius impeller-type agitator and with the agitator rotation speed as low as 100 rpm. This comminution operation typically lasts for between about 30 minutes and 10 hours.

The step of removing the vaporizable plasticizer component from the comminuted first resin composition is typically carried out by maintaining the mixture of the first resin components and the organic medium at an elevated temperature above the boiling temperature of the vaporizable plasticizer component. Under the condition, the vaporizable plasticizer component evaporates from the comminuted particulate resin composition and subsequently from the processing vessel. The process may be more expeditiously carried out when the vaporizable plasticizer composition is immiscible with the organic medium. The removal step is stopped when the vaporous effluent from the process vessel does not show a trace of the vaporizable plasticizer component.

The steps of dispersion, comminution and removal of the vaporizable plasticizer component may be conducted in distinctive and discontinuous steps, sequentially in a single vessel or in a series of overlapping steps in a single vessel.

The step of recovering the comminuted toner particles is carried out by first cooling the content of the process vessel below the glass transition temperature of the resin component and subsequently by filtering solid toner particles from the organic medium. Any suitable filtration equipment may be used. Subsequently, dry toner particles are obtained by washing the filtered particles with a low boiling organic solvent such as isohexane and drying off the wash solvent at a temperature below the glass transition temperature of the resin component.

The toner particles may then be coated with a suitable flowability improvement agent. They generally help to enhance the flowability of the particles during their use as color toner. Suitable flow agents are materials such as finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyldisilazane and available under the trade name Cab-O-Sil® T-530 from Cabot Corporation, Tuscola, Ill.) is mixed with the CCA-coated particles and blended well in a tumble mixer for about 10–60 minutes to obtain flow agent-coated toner particles.

In another aspect of the present invention, there is provided a particulate toner composition comprising toner particles that are substantially spherical in shape, have an average diameter of from about 1 to about 10 microns, and have a uniform and narrow size distribution with the span value less than 1.0, more preferably, with the span value less than 0.8 prepared by comminuting a precursor composition comprising a vaporizable plasticizer component in an organic medium under shear at an elevated temperature wherein the particles are substantially insoluble in the organic medium. The toner resin may be a polyester resin or a styrene copolymer resin. The developer compositions may further include carrier particles. Such particles are typically selected from the group consisting of ferrite, steel, iron powder, and mixtures thereof, wherein the powders have a surface active agent coated thereon.

In yet another aspect of the present invention, there is provided a particulate toner composition comprising toner particles that are substantially spherical in shape, have an average diameter of from about 1 to about 10 microns, have a uniform and narrow size distribution with the span value less than 1.0, more preferably, with the span value less than 0.8 and further have an irregular surface texture characterized by the surface roughness index greater than 1.2, the surface roughness index being defined as the ratio of surface areas of the irregular textured particles and smooth texture particles. The toner resin may be a polyester resin or a styrene copolymer resin. The developer compositions may further include carrier particles. Such particles are typically selected from the group consisting of ferrite, steel, iron powder, and mixtures thereof, wherein the powders have a surface active agent coated thereon.

In still yet another aspect of the present invention, there is provided a particulate toner composition comprising a polyester resin component and a colorant component wherein the particles are substantially spherical in shape, have a volume average diameter in the range of from about 1 to about 10 microns, have a uniform and narrow size distribution with the span value less than 1.0, more preferably, with the span value less than 0.8 and further have an irregular surface texture characterized by the surface roughness index greater than 1.2 wherein the polyester resin component includes a polyester resin having a weight average molecular weight of about 100,000 g/mol or less.

In a still further aspect of the present invention, there is provided a particulate toner composition comprising a styrene copolymer resin component and a colorant component wherein the particles are substantially spherical in shape, have a volume average diameter in the range of from about 1 to about 10 microns, have a uniform and narrow size distribution with the span value less than 1.0, more preferably, with the span value less than 0.8 and further have an irregular surface texture characterized by the surface roughness index greater than 1.2 wherein the styrene copolymer resin component includes a styrene copolymer having a weight average molecular weight of about 100,000 g/mol or less. Particularly preferred styrene copolymer resins include copolymers of styrene and acrylate as well as copolymers of styrene and butadiene.

In accordance with the present invention, it is preferable to produce small toner particles which have a volume average particle size (L) in the range 1–10 $\mu$m. The terms "volume average particle size" is defined in, for example, *Powder Technology Handbook*, 2nd edition, by K Gotoh et al, Marcell Dekker Publications (1997), pages 3–13. More specifically, it is preferable to produce toner particles which include particles with the span value less than 1.0. This is because the toner particles with such a narrow particle size distribution provide toner particles which have uniform quantity of electric charge in each toner particle, and can provide high-quality copy images and for which charge control is easy in a development unit.

In the present invention, the particle size distribution is determined using a commercially available Coulter LS Particle Size Analyzer (made by Coulter Electronics Co., Ltd., St. Petersburg, Fla.). The data are often represented by the cumulative volumetric diameter distribution diagram in which the volume fraction (or the percent by volume) of the particles with the diameter less than a value is plotted against the diameter value. It was stated earlier that the span is a measure of the narrowness of the diameter distribution and is defined as the ratio of the diameter range in which the middle 80 percent by volume of the particles occupy to the median diameter. More specifically, the span is defined by the formula, $$\text{Span}=(d_{90}-d_{10})/d_{50}.$$

Here $d_{10}$ is the diameter value at which the volume fraction is 10 percent by volume in the cumulative volumetric diameter distribution diagram, $d_{90}$ the diameter value at which the volume fraction is 90 percent and $d_{50}$ the diameter value at which the volume fraction is 50 percent. Therefore, a smaller span value means a narrow distribution of the particle diameter.

The surface area of particulate resin composition is determined from the BET adsorption isotherm measurement. The BET isotherm is measured using a commercially available Automatic Volumetric Sorption Analyzer (Model No. ASAP2000, Micromeritics Instrument Corporation, Norcross, Ga.). In the measurement, the amount of adsorptive ($N_2$ in our case) adsorbed on the particle surface at a reduced pressure is determined. The surface area is estimated from a lot of the adsorptive amount relative to the pressure. A detailed description of the experimental method and the theoretical basis of the BET adsorption isotherm may be found in pp. 615–631, "Physical Chemistry of Surfaces," $6^{th}$ edition, by A. W. Adamson and A. P. Cast (1997), John Wiley and Sons, NY, N.Y.

The surface roughness index used in the present invention is defined as the ratio of surface area ($A_{exp}$) of 1 gram of the particulate resin composition as determined by the BET isotherm method to the surface area of 1 gram of hypothetical spherical resin particles which have a perfectly smooth surface and also have a uniform distribution of diameter that is equal to the volume average diameter ($d_v$) of the actual particulate resin. The surface roughness index may then be represented by the formula;

$$\text{Surface roughness index}=(1/6)\rho d_v A_{exp},$$

where $\rho$ is the density of the polymer resin. The index is a measure of how increased the surface area is due to surface roughness.

The optical absorption density of the solid part of a printed image was determined with an Optical Density Meter (Model No. TR1224, available from Macbeth Company, New Windsor, N.Y.).

The features of the present invention will become apparent in the course of the following description of examples, which are given for illustration of the invention and are not intended to be limiting thereof.

EXAMPLES

Example 1

A cyan polyester toner composition comprising a polyester resin, a cyan pigment and a charge control agent was prepared by the following procedure. Polyester resin was a propoxylated bisphenol-A polyester resin (Fine Tone™ 382ES commercially available from Reichold Chemicals, Incorporated, Research Triangle Park, N.C.), the pigment was C. I. Pigment Blue 15:3 with Color Index Constitution Number 74160 (Heliogen™ Blue D7100 obtainable from BASF Corp., Charlotte, N.C.) and the charge control agent was a negative charge control agent (Bontron™ E-88 available from Orient Chemical Corporation, Springfield, N.J.).

Into a 2000-ml round-bottom flask equipped with an impeller-type agitator and a condenser, 500 grams of polymer resin, 25 grams of the pigment, 10 grams of the CCA, 150 grams of dimethylformamide (available from Aldrich Chemical Company, Milwaukee, Wis.) as the vaporizable plasticizer (processing aid) component and 15 grams of aluminum trihydorxide (available from Aldrich Chemical Company, Milwaukee, Wis.) as a CCA complement were charged. The content was agitated to form a mixture and then heated to 150□ under a total reflux condition. The resin mixture was maintained at the temperature under an agitation of 50 rpm impeller rotation for 60 minutes after it had attained a sufficient fluidity. The mixture became transparent indicating that the additives were finely dispersed in the resin melt.

500 grams of 1:1 mixture of Isopar-L® and Isopar-V® (available from Exxon Chemical Company, Houston, Tex.) as the immiscible solvent component and 50 grams of Ganex V220 (available from ISP Corporation, Wayne, N.J.) were charged into the round bottom flask which contained the resin composition and was maintained under agitation at 150° C. After completing the charging, the mixture was further maintained at the temperature under an increased shearing of 400 rpm impeller rotation. The mixture turns opalescent in appearance after about 10 minutes at which point the condenser was adjusted to a partial reflux condition. After 4 hours of shearing at 150° C., the vapor effluent stopped showing a trace of dimethylformamide and the dispersion was allowed to cool down to the ambient temperature. The comminuted toner particles were separated from the organic medium using a filtration process. The entrained organic medium in the filter cake was washed off by re-dispersing the filter cake in isohexane and re-filtering three times. The re-filtered particles were vacuum-dried at 40° C. for 16 hours to obtain dry toner particles. 100 parts by weight of the dry toner particles were blended with 1 parts by weight of Cab-O-Sil® TG-308F (a fumed silica acting as a flowability improvement agent from Cabot Corporation, Tuscola, Ill.) for 15 minutes in a roll mill, whereby a cyan toner No. 1—1 was obtained according to the present invention.

The resulting cyan toner contained 90.9 percent by weight of the polyester resin, 4.5 percent by weight of C. I. Pigment Blue 15:3 and 1.8 percent by weight of the charge control agent. When the particle size was determined, the volume average particle size was 4.7 microns and the span 0.6. Scanning electron microscopy examination of the toner particles showed that the particles were substantially spherical with a serrated surface texture. The surface roughness index as determined by the BET isotherm measurement was about 2.0.

Example 2

Into a 2000-ml round-bottom flask equipped with an impeller-type agitator and a condenser, 500 grams of polymer resin, 25 grams of the pigment, 150 grams of dimethylformamide (available from Aldrich Chemical Company, Milwaukee, Wis.) as the processing aid, that is, vaporizable plasticizer component and 15 grams of aluminum trihydorxide (available from Aldrich Chemical Company, Milwaukee, Wis.) as a CCA complement were charged. The content was agitated to form a mixture and then heated to 150° C. under a total reflux condition. The resin mixture was maintained at the temperature under an agitation of 50 rpm impeller rotation for 60 minutes after it had attained a sufficient fluidity. The mixture became transparent indicating that the additives were finely dispersed in the resin melt.

500 grams of 1:1 mixture of Isopar-L® and Isopar-V® (available from Exxon Chemical Company, Houston, Tex.) as the immiscible solvent component and 25 grams of Ganex V220 (available from ISP Corporation, Wayne, N.J.) were charged into the round bottom flask which contained the resin composition and was maintained under agitation at 150° C. The mixture was subjected to the same procedure as in Example 1 to produce Cyan Toner 1–2 according to the present invention.

The resulting Cyan Toner No. 1–2 contained 92.6 percent by weight of the polyester resin, 4.6 percent by weight of C. I. Pigment Blue 15:3 and 2.7 percent by weight of aluminum trihydroxide. When the particle size was determined, the volume average particle size was 6.0 microns and the span 0.8. When compared to the particles size result of Example 1, it indicates that the particle size may be controlled with the amount of surfactant used in comminuting. Scanning electron microscopy examination of the toner particles showed that the toner particles were substantially spherical with coarse surface texture. The surface roughness index as determined by the BET isotherm measurement was about 1.9.

Example 3

A magenta polyester toner composition was prepared using C. I. Pigment Red 81:3 (Rhodamine YS PMA commercially available from Magruder Color Company, Elizabeth, N.J.) in place of the C. I. Pigment Blue 15:3 of the cyan toner composition of Example 1 by following the same procedure as in Example 1.

The resulting magenta toner composition contained 90.9 percent by weight of the polyester resin, 4.5 percent by weight of C. I. Pigment Red 81:3 and 1.8 percent by weight of E-84 charge control agent. When the particle diameter was determined, the volume average particle diameter was 5.0 microns and the span 0.8. Scanning electron microscopy examination of the toner particles showed that the toner particles were substantially spherical with coarse surface texture. The surface roughness index as measured by the BET isotherm method was 1.9.

Example 4

A yellow polyester toner composition is prepared using C. I. Pigment using C. I. Pigment Yellow 185 (Enceprint Yellow 1155 commercially available from BASF Corporation, Charlotte, N.C.) in place of the C. I. Pigment Blue 15:3 of the cyan toner composition of Example 1 by following the same procedure as in Example 1.

The resulting yellow polyester toner composition contains 91.0 percent by weight of the polyester resin, 4.4 percent of C. I. Pigment Yellow 185 and 1.8 percent by weight of E-84 charge control agent. When the particle diameter is determined, the volume average particle diameter is 4.7 microns and the span 0.8.

Examination of the toner particles with scanning electron microscopy reveals that the toner particles are substantially spherical with a serrated surface texture. The surface roughness texture as measured by the BET isotherm method is about 1.9.

Example 5

A black polyester toner composition comprising a polyester resin, a carbon black and a charge control agent was prepared by the following procedure.

Polyester resin was a propoxylated bisphenol-A polyester resin (Fine Tone™382ES), the pigment was Carbon Black S160 (available from Degussa Corporation, Dusseldorf, Germany) and the charge control agent was a negative charge control agent (Bontron™ E-88).

Into a 2000-ml round-bottom flask equipped with an impeller-type agitator and a condenser, 500 grams of the polyester resin, 25 grams of the carbon black and, 10 grams of the CCA, 150 grams of dimethylformamide (available from Aldrich Chemical Company, Milwaukee, Wis.) as the vaporizable plasticizer component were charged. The content was agitated to form a mixture and then heated to 150° under a total reflux condition. The resin mixture was maintained at the temperature under an agitation of 50 rpm agitator rotation for 60 minutes after it had attained a sufficient fluidity.

500 grams of 1:1 mixture of Isopar-L® and Isopar-V® (available from Exxon Chemical Company, Houston, Tex.) as the immiscible solvent component and 50 grams of Ganex V220 (available from ISP Corporation, Wayne, N.J.) were charged into the flask which contained the resin composition and was maintained under agitation at 150° C. After completing the charging, the mixture was further maintained at the temperature under an increased shearing of 400 rpm impeller rotation. The mixture turns opalescent in appearance after about 10 minutes at which point the temperature was raised to 180° C. and the condenser was adjusted to a partial reflux condition. After 4 hours of shearing at 180° C., the vapor effluent stopped showing a trace of dimethylformamide and the dispersion as allowed to cool down to the ambient temperature. The comminuted toner articles were separated from the organic medium using a filtration process. The entrained organic medium in the filter cake was washed off by re-dispersing the filter cake in isohexane and re-filtering three times. The re-filtered particles were vacuum-dried at 40° C. for 16 hours to obtain dry toner particles. 100 parts by weight of the dry toner particles were blended with 1 parts by weight of Cab-O-Sil® TS-720 (a fumed silica acting as a flowability improvement agent from Cabot Corporation, Tuscola, Ill.) for 15 minutes in a roll mill, whereby a cyan toner No. 1-1 was obtained according to the present invention.

The resulting black toner contained 93.0 percent by weight of the polyester resin, 4.9 percent by weight of carbon black and 2.1 percent by weight of the charge control agent. When the particle size was determined, the volume average particle size was 4.7 microns and the span 0.6. Scanning electron microscopy examination of the toner particles showed that the particles were substantially spherical with a serrated surface texture. The surface roughness index as determined by the BET isotherm measurement was about 2.2.

Example 6

A cyan polyester toner composition comprising a polyester resin, a cyan pigment and a charge control agent was prepared by a similar procedure of Example 1 except that the vaporizable plasticizer was acetone instead of N,N-dimethylformamide.

Into a 2000-ml round-bottom flask equipped with an impeller-type agitator and a condenser, 500 grams of Fine Tone™ 382ES polyester resin, 25 grams of Heliogen™ pigment, 10 grams of Bontron™ E-88, and 300 grams of acetone as the vaporizable plasticizer component charged. The content was agitated to form a mixture and then heated to 50° under a total reflux condition. The resin mixture was maintained at the temperature under an agitation of 50 rpm impeller rotation for 60 minutes after it had attained a sufficient fluidity. The mixture became transparent indicating that the additives were finely dispersed in the resin melt.

500 grams of 1:1 mixture of Isopar-L® and Isopar-V® (available from Exxon Chemical Company, Houston, Tex.) as the immiscible solvent component and 50 grams of Ganex V220 (available from ISP Corporation, Wayne, N.J.) were charged into the round bottom flask which contained the resin composition and was maintained under agitation at 50° C. After completing the charging, the mixture was further maintained at the temperature under an increased shearing of 300 rpm impeller rotation. The mixture turns opalescent in appearance after about 10 minutes at which point the condenser was adjusted to a partial reflux condition. After 4 hours of shearing at 65° C., the vapor effluent stopped showing a trace of acetone and the dispersion was allowed to cool down to the ambient temperature. The comminuted toner particles were recovered and dried by a similar method of Example 1.

The resulting cyan toner contained 93.2 percent by weight of the polyester resin, 4.9 percent by weight of C. I. Pigment Blue 15:3 and 1.9 percent by weight of the charge control agent. When the particle size was determined, the volume average particle size was 4.8 microns and the span 0.6. Scanning electron microscopy examination of the toner particles showed that the particles were substantially spherical with a serrated surface texture. The surface roughness index as determined by the BET isotherm measurement was about 2.0.

Example 7

(Counter Example)

Comminution without a Vaporizable Plasticizer Component

A particulate cyan toner composition was prepared using the same procedure of Example 1 but without N,N-dimethylformamide, the processing aid. The volume average diameter of the toner particles was 5.1 microns and the span 2.0. Scanning electron microscopy examination of the toner particles showed that the particles were substantially spherical with smooth surface texture. The surface roughness index determined by the BET isotherm was 1.

Example 8

Into a 500-ml round-bottom flask equipped with an impeller-type agitator and a condenser, 50 grams of a styrene-acrylate copolymer resin and 2.5 grams of C.I. Pigment Blue 15:3 were blended with 60 grams of tetrahydofuran (available from Aldrich Chemical Company, Milwaukee, Wis.) as the vaporizable plasticizer component were charged at ambient temperature. The content was agitated to form a mixture and then heated to 50° under a total reflux condition. The resin mixture was maintained at the temperature under an agitation of 50 rpm impeller rotation for 60 minutes after which it had attained a sufficient fluidity. The mixture became transparent indicating that the additives were finely dispersed the resin melt.

Subsequently, 100 grams of distilled water as the immiscible solvent component and 2.5 grams of sodium dodecylsulfate as the surfactant were charged into the round bottom flask which contained the resin composition and was maintained under agitation at 50° C. After completing the charging, the mixture was further maintained at the temperature under an increased shearing of 100 rpm impeller rotation. The mixture turns opalescent in appearance after about 10 minutes at which point the condenser was adjusted to a partial reflux condition. After 2 hours of shearing at 50° C., the temperature of the content of the flask was raised to 80° C. to expedite the evaporation of tetrahydrofuran. The content was maintained at the shearing condition until the vapor effluent stopped showing a trace of tetrahydrofuran and the dispersion was allowed to cool down to the ambient temperature. The comminuted toner particles were separated from the solvent medium using a filtration process. The entrained solvent medium in the filter cake was washed off by re-dispersing the filter cake in water and re-filtering three times. The re-filtered particles were vacuum-dried at 60° C. for 10 hours to obtain dry toner particles. 100 parts by weight of the dry toner particles were blended with 1 parts by weight of Cab-O-Sil® TG-308F (a filmed silica acting as a flowability improvement agent from Cabot Corporation, Tuscola, Ill.) for 15 minutes in a roll mill, whereby a cyan toner No. 2-1 was obtained according to the present invention.

The resulting cyan styrene-acrylate toner composition had the volume average particle diameter of 6.8 micron and the span of 0.7. Scanning electron microscopy examination of the toner particles showed that the toner particles were substantially spherical with a coarse surface texture. The surface roughness texture of the toner particles as determined by the BET isotherm methods was 2.2.

Example 9

A magenta styrene-acrylate toner composition (cyan toner No. 2-2) is prepared using 4 grams of sodium-dodecylsulfate in place of 2.5 grams but otherwise by following the same procedure as in Example 5. The volume average particle diameter of the toner particles is 4.8 micron and the span 0.9. Scanning electron microscopy examination of the toner particles shows that the particles are substantially spherical with a coarse surface texture. The surface roughness index as determined with the BET isotherm method is 2.0.

Example 10

A magenta styrene-acrylate toner composition is prepared using C. I. Pigment Red 81:3 in place of the C. I. Pigment Blue 15:3 in the cyan toner composition of Example 5 by following the same procedure as in Example 5. The volume average particle diameter of the toner particles is 4.8 micron and the span 0.7. Scanning electron microscopy examination of the toner particles shows that the particles are substantially spherical with a serrated surface texture.

Example 11

A yellow styrene-acrylate toner composition is prepared using C. I. Pigment Yellow 185 in place of the C. I. Pigment Blue 15:3 in the cyan toner composition of Example 5 by following the same procedure as in Example 5. The volume average particle diameter of the prepared toner particles is 5.1 micron and the span 0.8. Scanning electron microscopy examination of the toner particles shows that the particles are substantially spherical with a coarse surface texture.

Example 12

Mono-component toner printing using a DC toner composition The toner composition of Example 1 was introduced in a color copier (Canon CLC-900, available from Canon Kabushiki Kaisha, Tokyo, Japan) and tested. Copies of a solid cyan image were produced. The copied image thickness was about 20 microns and the image had a high optical density of 1.55. After 40,000 copies, the optical density was 1.51 which was close to the initial value.

Figure 2:
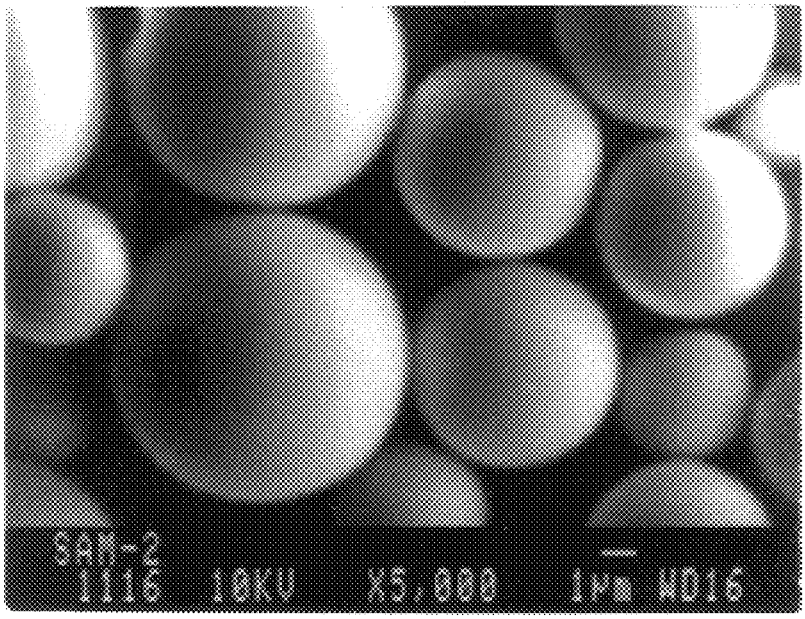
FIG. 2 is a scanning electron micrograph of a toner composition of which particles have smooth surface texture.
Figure 3:
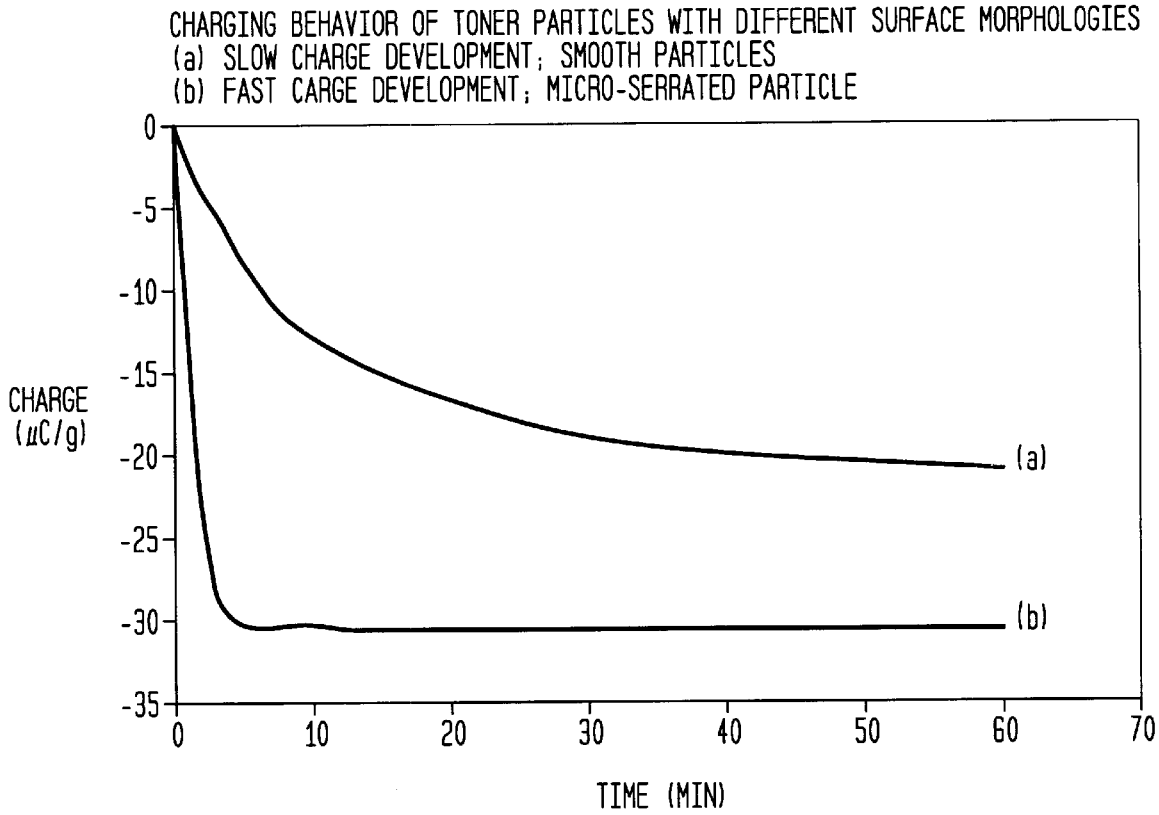
FIG. 3 is a plot of triboelectric charge development as a function of toner-carrier mixing time. The data demonstrates that the micro-serrated surface texture is conducive for rapid charge development.

The invention is perhaps better appreciated by viewing FIGS. 1–3. FIG. 1 is a photomicrograph (5000X) showing toner particles with the micro-serrated surface generally of the type achieved in accordance with the present invention. FIG. 2, on the other hand is a photomicrograph of particles having smooth surfaces. The micro-serrated particles of the present invention typically develop charge more quickly then conventional smooth particles as can be seen in FIG. 3. FIG. 3 is a plot of triboelectric charge development as a function of toner-carrier mixing time. It will be appreciated from FIG. 3 that micro-serrated particles develop a charge of 50 micro coulombs per gram in a fraction of the time required to impart a similar charge to smooth particles.

While the invention has been illustrated and described in connection with numerous embodiments, modification to such embodiments within the spirit and scope of the present invention will be readily apparent to those of skill in the art. The invention is defined in the appended claims.

What is claimed is:

1. A process for preparing a finely divided, comminuted particulate toner composition for developing latent electrostatic images comprising:

(a) preparing a first resin composition comprising a resin component, a vaporizable plasticizer component, a colorant component, optionally a charge control agent and optionally toner additives;

(b) dispersing said first resin composition in an organic medium comprising an organic solvent component and a surfactant, said resin being substantially insoluble in said organic medium;

(c) comminuting said first resin composition in said organic medium by way of application of shear thereto at a first elevated temperature;

(d) removing said vaporizable plasticizer component from said comminuted resin particles by evaporating said vaporizable plasticizer component at a second elevated temperature; and (e) recovering said comminuted particulate toner composition from said organic medium.

2. The method according to claim 1, wherein the toner particles of said comminuted toner composition are substantially spherical in shape and have a volume average diameter in the range of from about one to about 10 microns, with the span value less than 1.0.

3. The method according to claim 2, wherein said toner particles have a volume average particle size of from about 3 to about 8 microns.

4. The method according to claim 2, wherein the span value is less than 0.8.

5. The method according to claim 2, wherein said toner particles have a micro-serrated surface texture characterized by a surface roughness index greater than 1.2.

6. The method according to claim 1, wherein the step of preparing said first resin composition comprises melt blending of said resin component with said vaporizable plasticizer component, said colorant component, said charge control agent and said toner additives.

7. The method according to claim 1, wherein said resin component is selected from the group consisting of polyester resins and styrene copolymer resins.

8. The method according to claim 7, wherein said resin component is an amorphous resin with the glass transition temperature in the range of from about 40 to about 90° C. and the weight average molecular weight in the range of from about 3,000 g/mol to about 100,000 g/mol.

9. The method according to claim 1, wherein said vaporizable plasticizer component is an organic solvent with the boiling temperature less than 200° C. which is soluble in said resin component by the concentration more than 1 percent by weight.

10. The method according to claim 9 wherein the vaporized plasticizer component is selected from the group consisting of acetone, 1,2-dichlroethane, tetrahydrofiuan, acetonitrile, 1 -meLhyl-2-pyrrolididone, methylethylketone, 3-pentanone, chlorobenzene, N,N-dimethylformamide, cyclohexanone, dimethylsulfoxide, chlorobenzene and mixtures thereof.

11. The method according to claim 9, wherein said vaporizable plasticizer component is immiscible with the said organic solvent component used in the step of dispersing said first resin composition.

12. The method according to claim 1, wherein said vaporizable plasticizer component is blended with said resin component in the amount between about 1 and about 200 weight percent of said resin component.

13. The method according to claim 12, wherein said vaporizable plasticizer component is blended with said resin component in the amount between about 5 and about 100 weight percent of said resin component.

14. The method according to claim 1, wherein said step of dispersing said first resin composition in said organic medium is carried out by introducing said first resin composition into said organic medium maintained at a temperature higher than the flow temperature of the first resin component under agitation.

15. The method according to claim 1, wherein said step of dispersing said first resin composition in said organic medium is carried out by introducing said organic medium into a vessel containing melt of said first resin composition under agitation.

16. The method according to claim 1, wherein said organic medium comprises a paraffin solvent.

17. The method according to claim 1, wherein said organic medium comprises a poly(ethylene glycol).

18. The method according to claim 1, wherein said surfactant is selected from the group consisting of vinylpyrrolidonone copolymers, alkylated maleic acid copolymer, polymers containing ethylene oxide moieties, polymers containing propylene oxide moieties, sodium dodecylsulfate and mixtures thereof.

19. The method according to claim 1, wherein said first resin composition is present in an amount of from about 10 to about 70 weight percent of the combined weight of said first resin composition and said organic medium during the step of comminuting said first resin composition.

20. The method according to claim 1, wherein said step of comminuting said first particulate resin composition is carried out by agitating the dispersion of said first resin composition in said organic medium at a temperature of from about 30° C. to about 200° C.

21. The method according to claim 1, wherein the step of removing said vaporizable plasticizer component from comminuted first resin component is carried out by maintaining the dispersion of said comminuted first resin component in said organic medium under agitation at an elevated temperature close to the boiling temperature of said vaporizable plasticizer component until effluent vapor stream from the said dispersion is substantially free of said vaporizable plasticizer component.

* * * * *